US008137028B2

(12) United States Patent
Wrobbel

(10) Patent No.: US 8,137,028 B2
(45) Date of Patent: Mar. 20, 2012

(54) SMALL BOAT DOCK RACKING SYSTEM

(76) Inventor: Edward Wrobbel, Canandaigua, NY (US)

( * ) Notice: Subject to any disclaimer, the term of this patent is extended or adjusted under 35 U.S.C. 154(b) by 233 days.

(21) Appl. No.: 12/656,545

(22) Filed: Feb. 3, 2010

(65) Prior Publication Data

US 2011/0188931 A1 Aug. 4, 2011

(51) Int. Cl.
*B63C 3/00* (2006.01)

(52) U.S. Cl. ..... 405/3; 114/366

(58) Field of Classification Search ..... 405/1, 3; 114/365, 366

See application file for complete search history.

(56) References Cited

U.S. PATENT DOCUMENTS

| | | | | |
|---|---|---|---|---|
| 2,185,083 | A | 12/1939 | Horton | |
| 2,294,864 | A | 9/1942 | Palmer | |
| 2,465,118 | A | 3/1949 | Platt | |
| 2,815,131 | A | 12/1957 | Lunsman et al. | |
| 3,143,991 | A | 8/1964 | Anderson | |
| 3,401,806 | A * | 9/1968 | Schmit | 114/366 |
| 4,763,593 | A | 8/1988 | Lasko | |
| 4,764,081 | A * | 8/1988 | Peterson | 405/3 |
| 4,864,951 | A * | 9/1989 | Koepp, Jr. | 114/366 |
| 5,193,479 | A * | 3/1993 | Bielefeld | 114/366 |
| 5,222,830 | A * | 6/1993 | Raguse | 405/3 |
| 2008/0017096 | A1 * | 1/2008 | Shepherd | 114/365 |

* cited by examiner

*Primary Examiner* — Frederic L Lagman
(74) *Attorney, Agent, or Firm* — Thomas J. Germinario

(57) ABSTRACT

A small vessel dock racking system provides a three-sided cradle that is rotatably connected to two lateral supports extending outward from one side of the dock. A person in the water can float the canoe or kayak into the cradle and lift it into a secure vertical storage position on the side of the dock without having to get up on the dock. A pivot point extending out into the water has the advantages of both accommodating freeboard and minimizing the distance between the pivot and the boat's center of gravity, thereby allowing for much less effort in lifting. Depending on the depth of the vessel, the cradle can be dimensioned so that the position of the vessel's center of gravity tends to hold the cradle in a vertical alignment after it's been lifted. Where needed, a cradle latch that can be activated from the water side further secures the storage position.

11 Claims, 13 Drawing Sheets

Fig. 1A - Storage Position
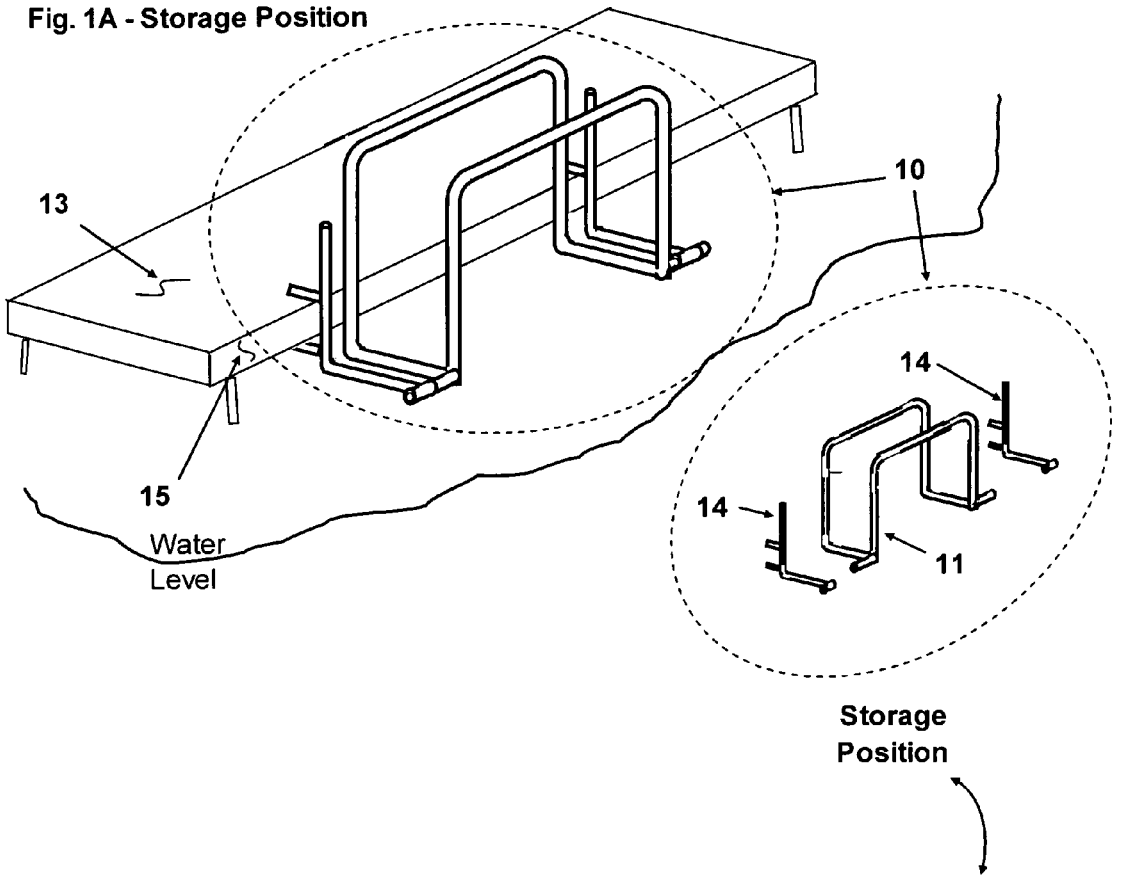
Fig. 1B - Loading Position
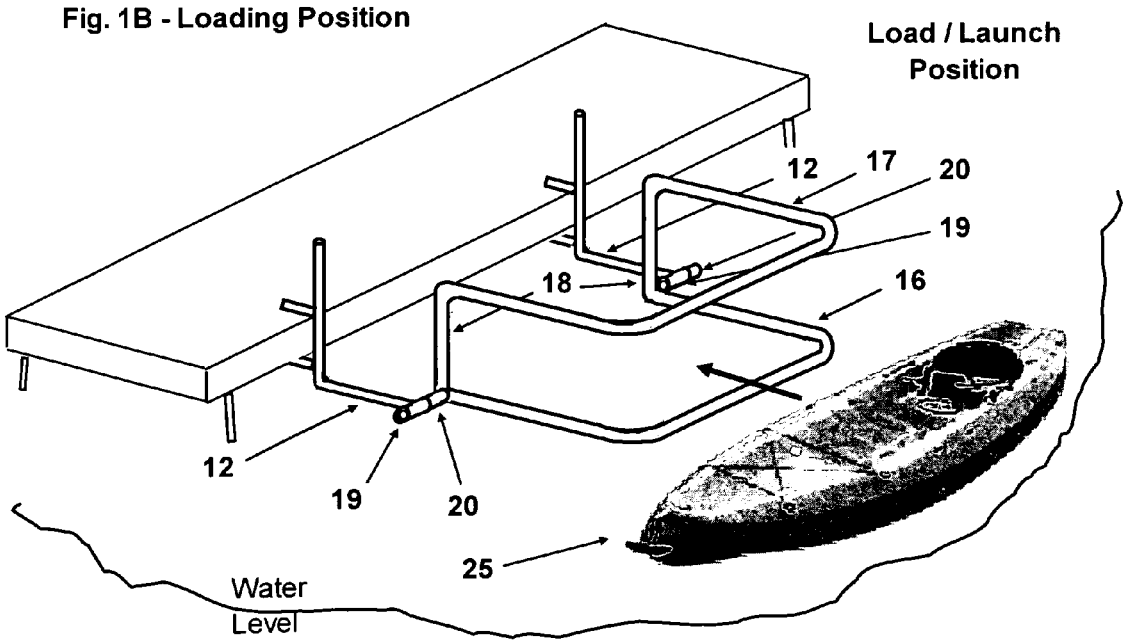

Fig. 2
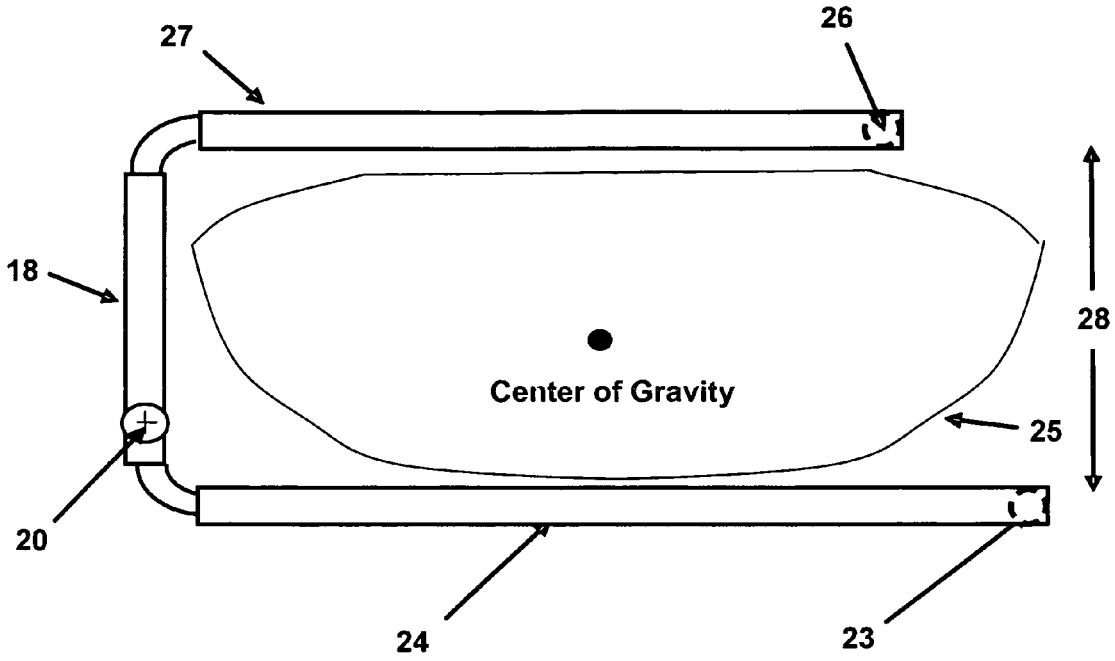
Fig. 3A - Cradle Height
Approximately the same as the Vessel height
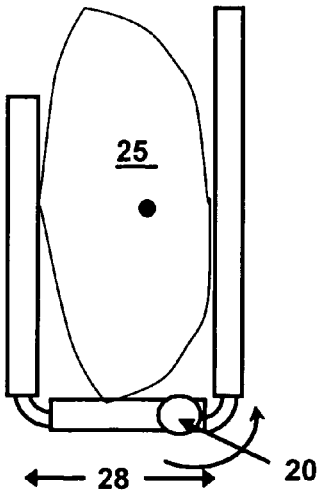
Fig. 3B - Cradle Height
Larger than the Vessel height
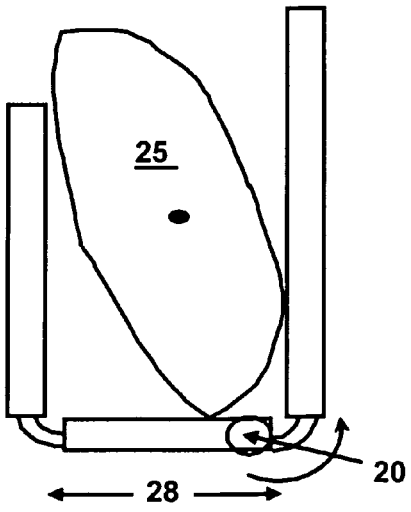

Rain Entry Angle for a Kayak and Canoe in the Storage Position

Longitudinal Position of Vessel Center of Gravity with Respect to Cradle Width

A Cradle Design using Rigid and Flexible Members

Fig. 7
Pivot Point Zones as a % of 28
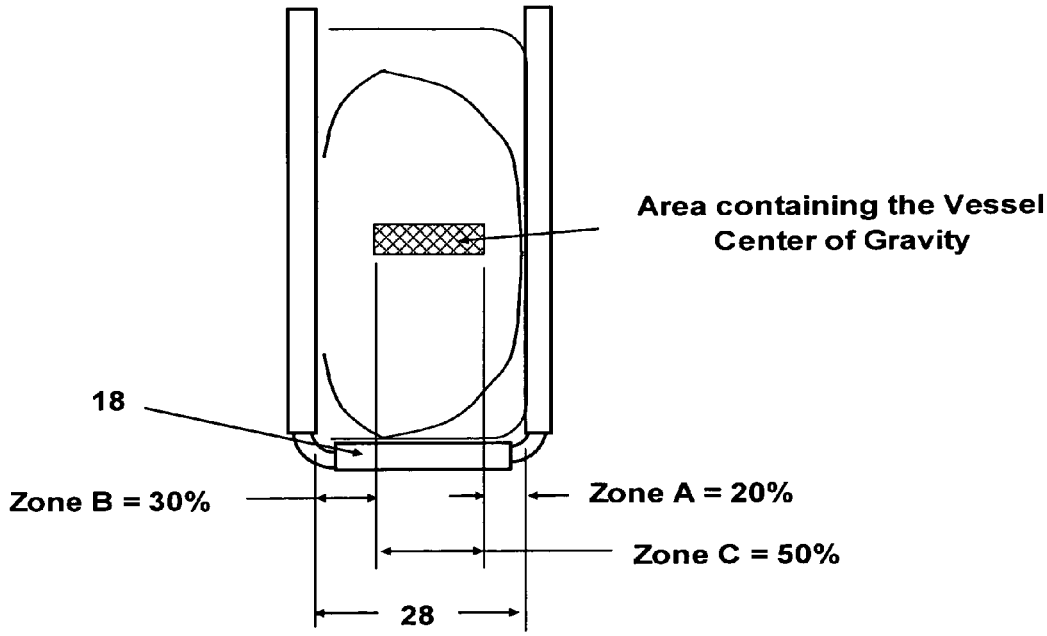
Fig. 8A – Essentially "0" Lift
Pivot at Junction of
Loading and Side Resting Members
Fig. 8B – Lift = Cradle Height
Pivot at Junction of
Upper and Side Resting Members
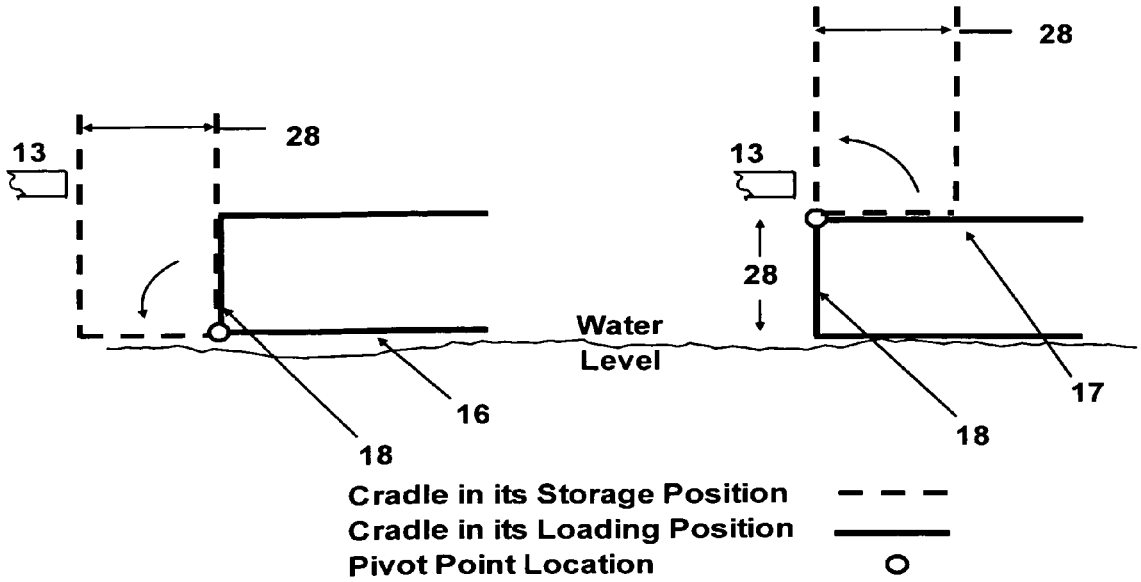

Fig. 9A - Rigid Cradle / Buoyancy Pivot Height Opportunity
Fig. 9B - Flexible Member Cradle: Pivot Height Opportunity
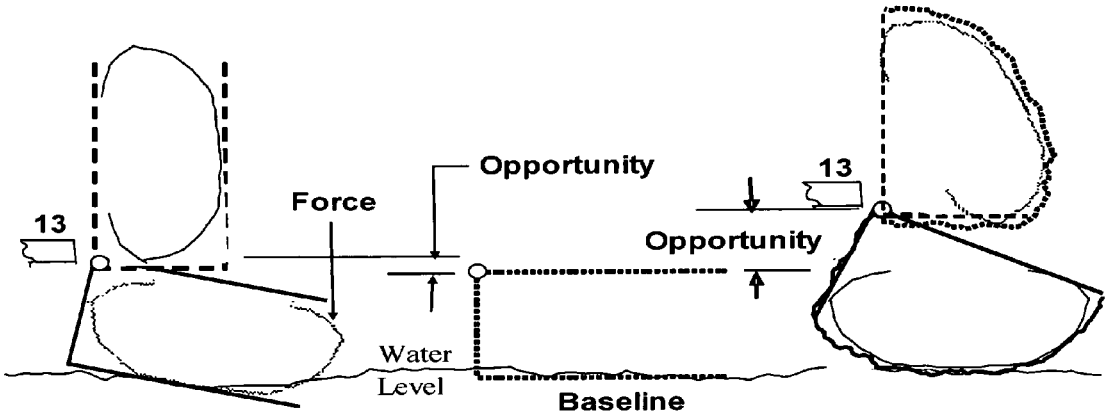
Fig. 10A
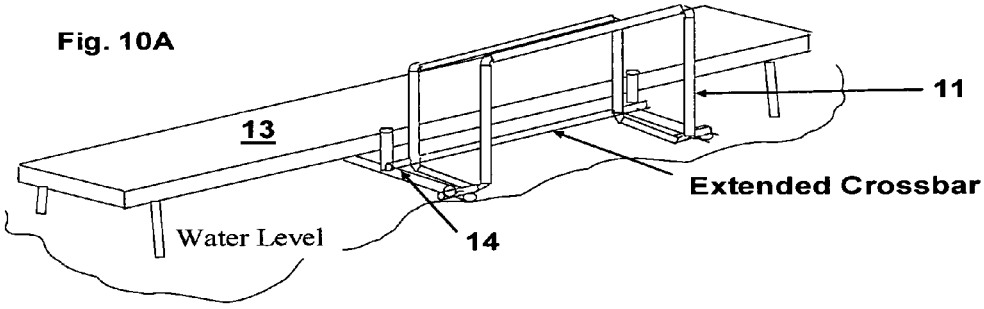
Fig. 10B
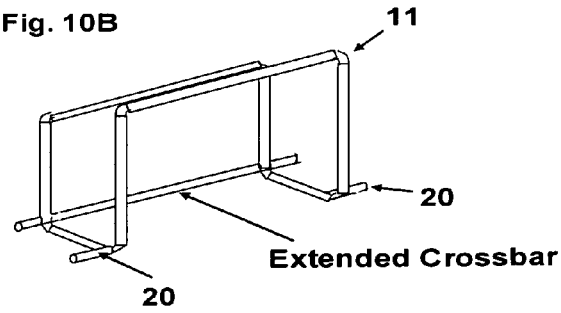
Fig. 10C
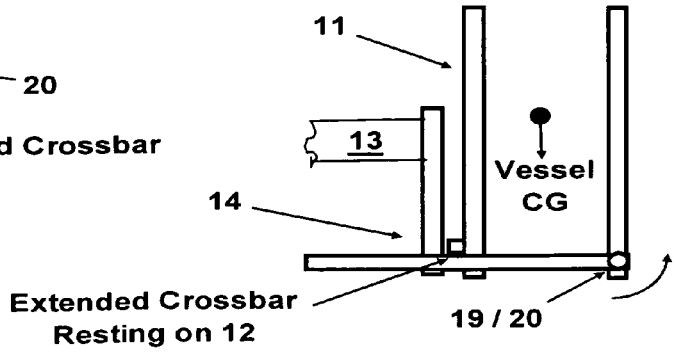

Components

Load Position

Storage Position

Loading
Position

After
Rotation

Storage
Position

Water
Level

O Sliding Pivot

Fig. 13A
Components
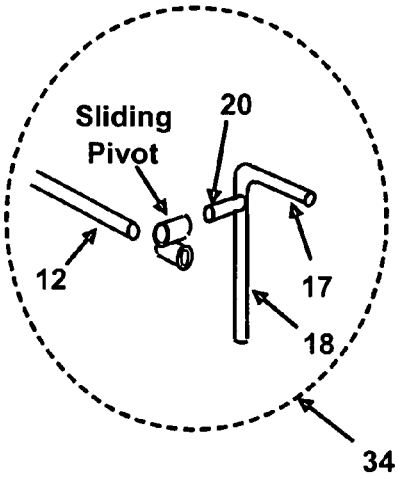
Fig. 13B
Loading
Position
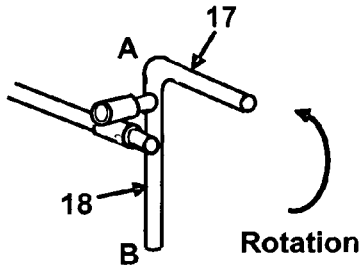
Fig. 13C
Storage
Position
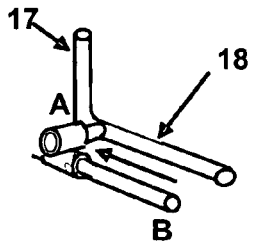
Fig. 14A
Loading
Position
Fig. 14B
After
Rotation
Fig. 14C
Storage
Position
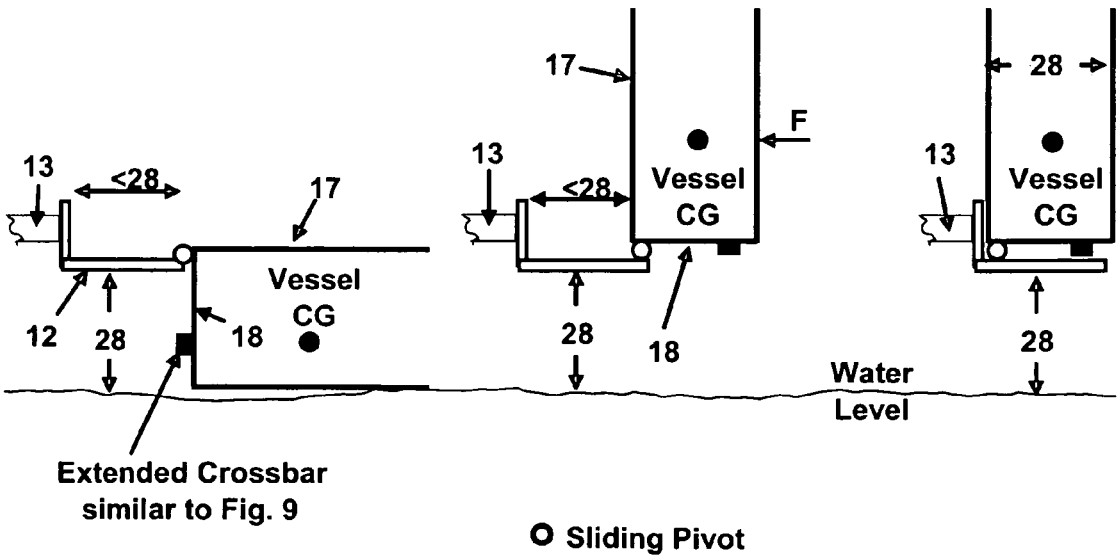

Components

Loading
Position

Storage
Position

Minimum Freeboard / Tallest Vessel

Maximum Freeboard / Shortest Vessel

Minimum Freeboard / Tallest Vessel

Maximum Freeboard / Shortest Vessel

Fig. 18A
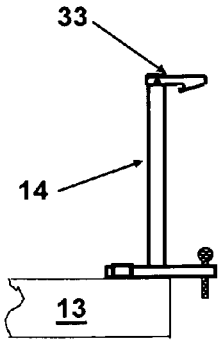
Fig. 18B
Components
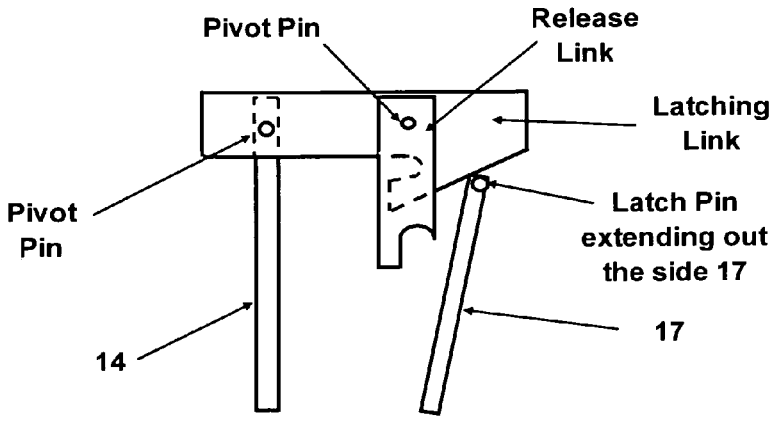
Fig. 19A - Latching Motion
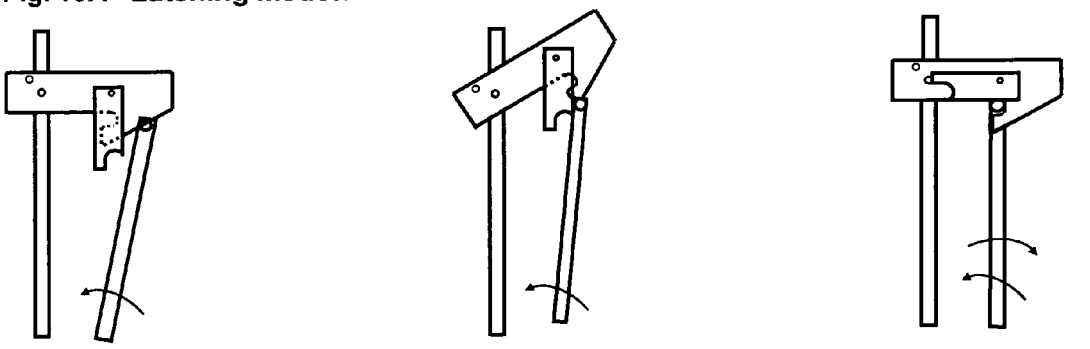
Cradle rotated upward
Rotation lifts Latch Link
Latch Link drops Latch Link engaged
Fig. 19B - Release Motion
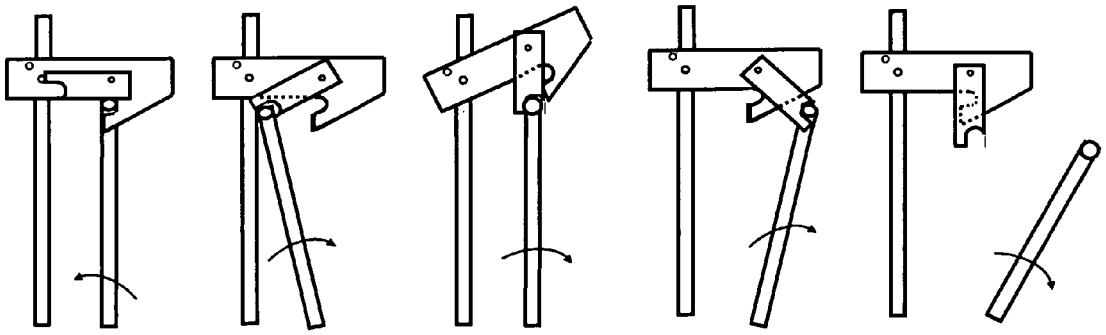
Rotate Toward Dock
Release Link Engages
Release Link Lifts Latch Link
Latch Pin Disengages
Cradle Rotating To Launch Position Fig. 20A - Bracket & Pin Dock Mount Assembly
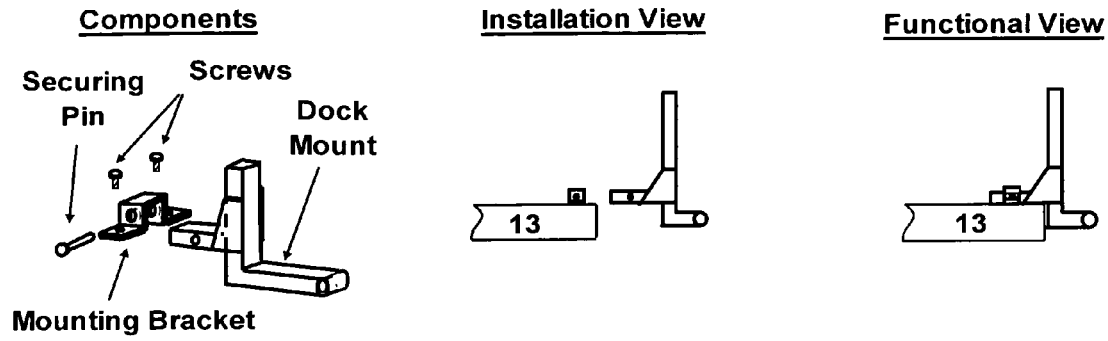
Fig. 20B - Hanging Bracket Dock Mount Assembly
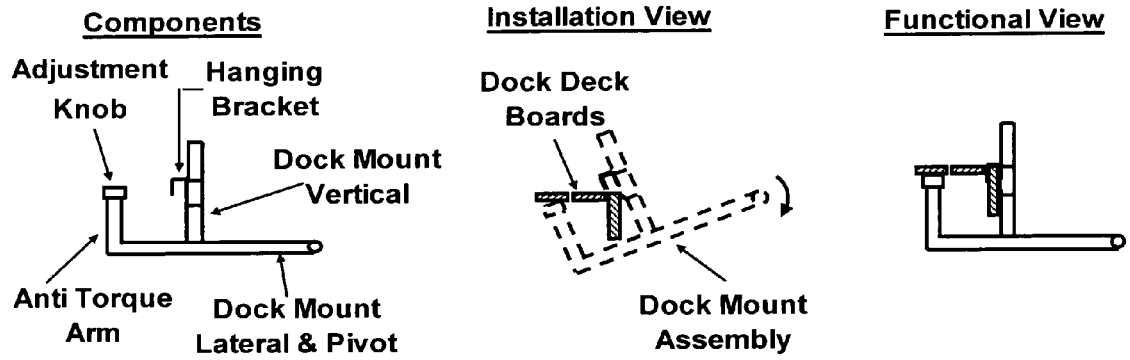
Fig. 20C - Surface Lateral / Pin Dock Mount Assembly
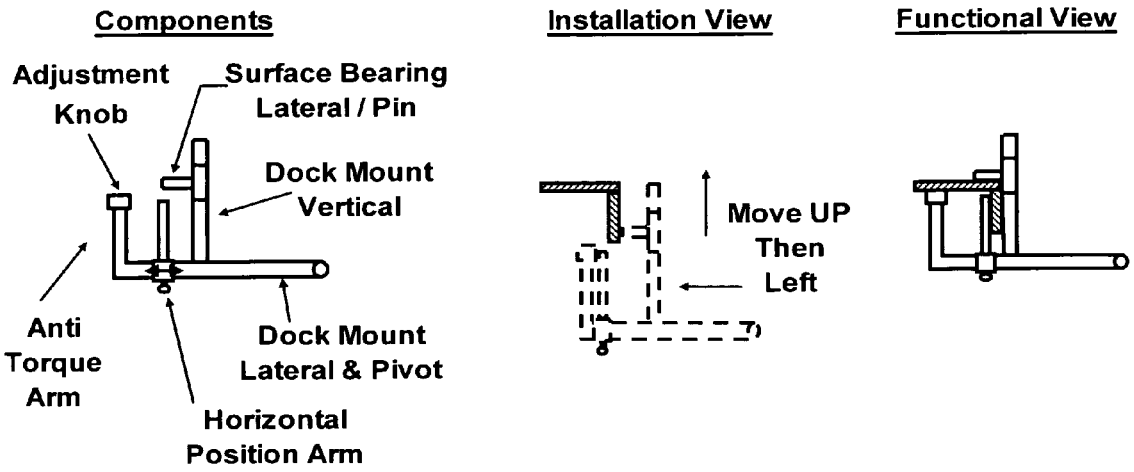

Spring Time Conditions

Fall Time Conditions

Freeboard
Variation

Spring Time Conditions

Fall Time Conditions

Freeboard
Variation

Fig. 23A
Spring Time Conditions
Fig. 23B
Fall Time Conditions
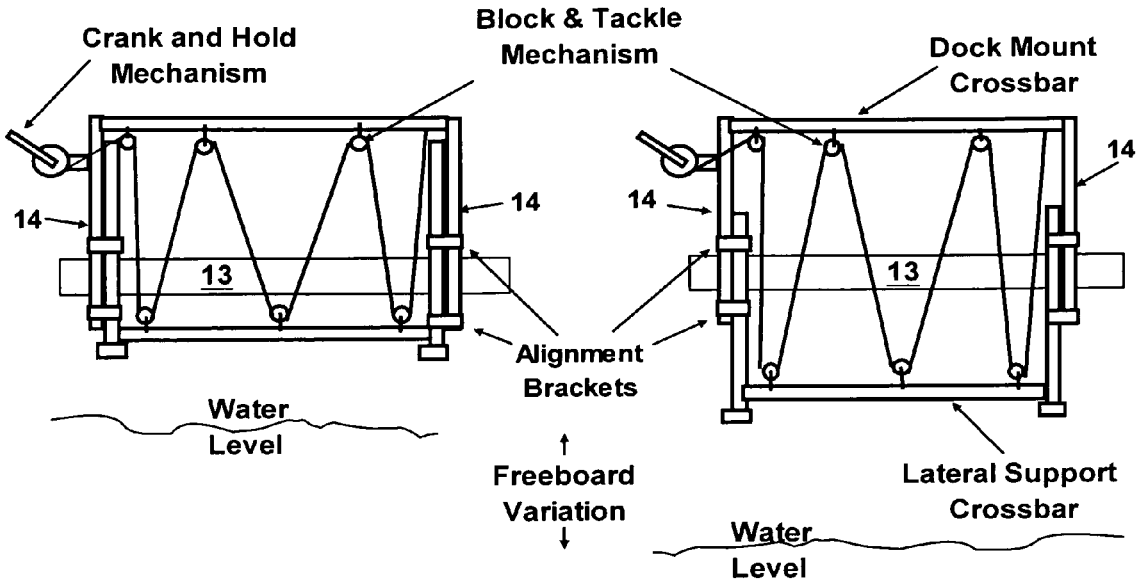
Fig. 24 A
Components
Fig. 24B
Spring Conditions
Fig. 24C
Fall Conditions
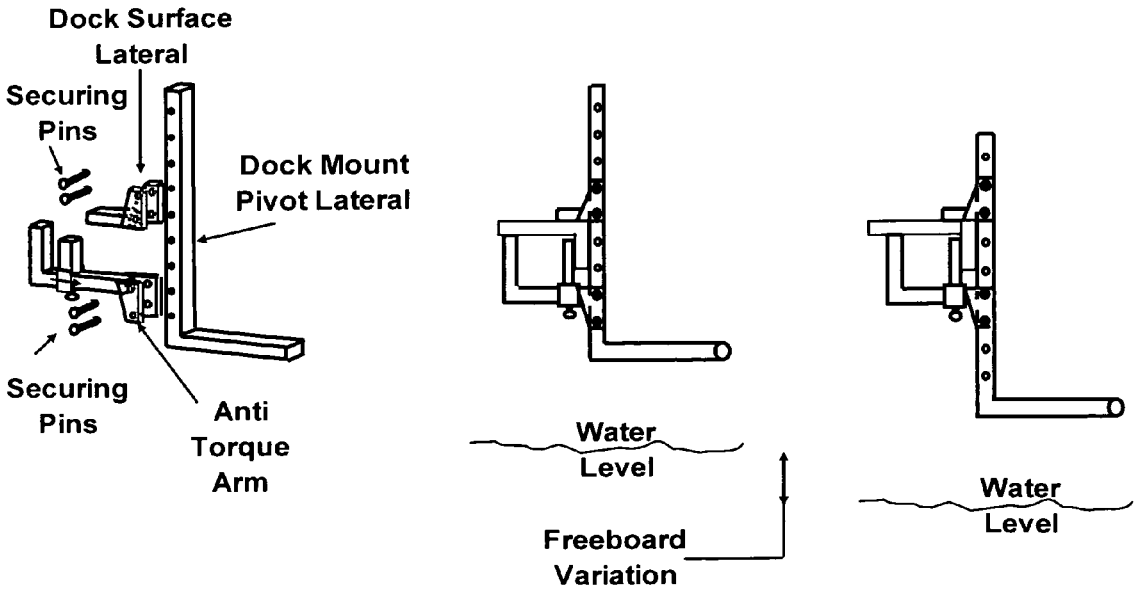

Fig. 25A
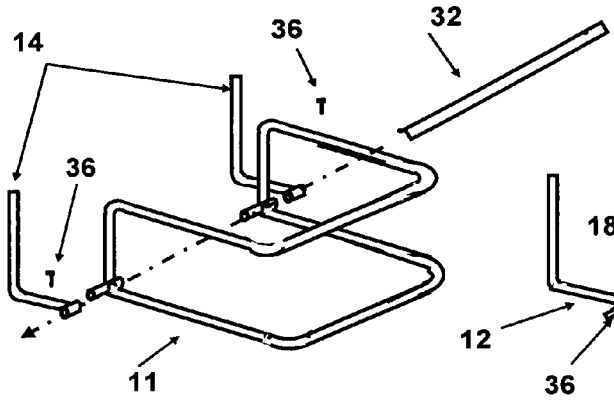
Fig. 25B
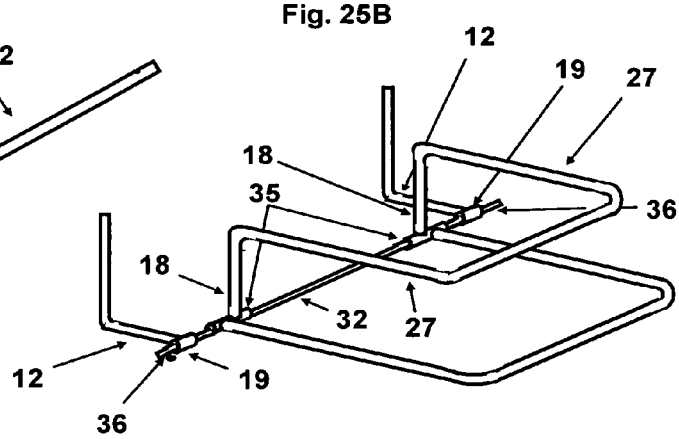
Loading View
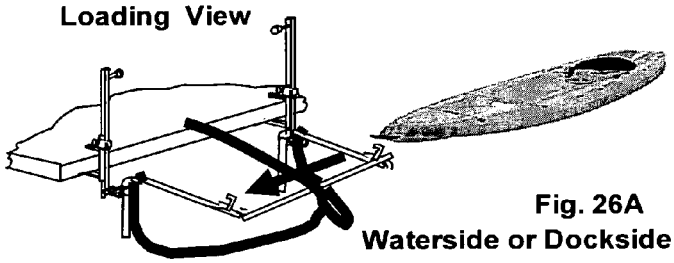
Storage View
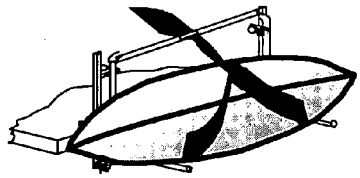
Fig. 26A
Waterside or Dockside Operation
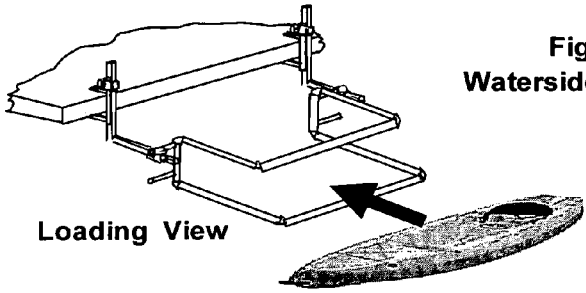
Fig. 26B
Waterside Operation
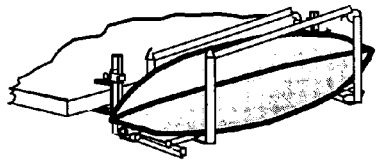
Loading View
Storage View
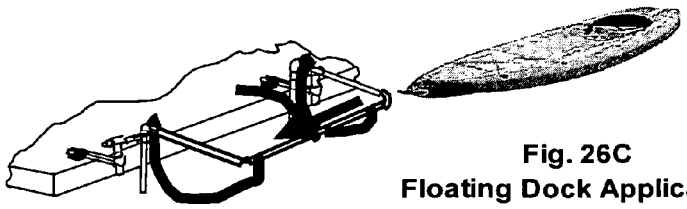
Fig. 26C
Floating Dock Application
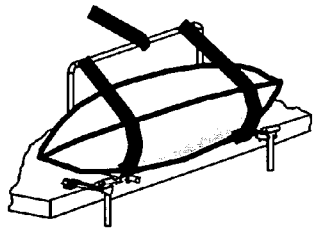
Loading View
Storage View

SMALL BOAT DOCK RACKING SYSTEM

BACKGROUND OF THE INVENTION

The present invention relates to the field of apparatus and methods for lifting small vessels out of the water and storing them when they are not in use. More particularly, the present invention relates to dock-mounted racks that are used to lift and store small boats.

When a small vessel, such as a canoe or kayak, is not in use, it is typically stored out of the water. In many instances, such storage requires that the vessel be lifted from the water and transported to a location away from the water or on a dock. Since these vessels usually weigh between 35 and 85 pounds and range in length from 9 to 17 feet, they are quite difficult to lift and cumbersome to transport, even over short distances, especially for one person.

Many small boat owners own or have access to a dock extending into the water. For these people, the most convenient place to store their vessels is on the dock. But when small vessels are stored on the dock surface, most of the dock width is obstructed, blocking access to the far end of the dock. Moreover, as there is typically a variance of 8 inches to 36 inches or more of freeboard between the dock surface and the water, lifting the boat onto the dock surface is clumsy at best if not impossible for one person and may result in damage to the boat and/or the dock and/or potential personal injury.

The prior art teaches a variety of hoists, davits and derricks for lifting small boats from the water onto the surface of a dock. The patent of Horton, U.S. Pat. No. 2,185,083, discloses a pivoting cradle by means of which a vessel is rotated into a sideways vertical position on the dock surface. Since the lifting force is provided by a winch mechanism on the dock side of the cradle, lifting from the water side is not enabled, and therefore one person cannot easily put the vessel into the cradle and then lift it without moving from the water side to the dock side. This necessitates a time-consuming two-stage process. The winch assembly and the lifted cradle also occupy considerable dock space and present an obstruction.

The patent of Anderson, U.S. Pat. No. 3,143,991, teaches a hoisting mechanism for lifting a dinghy onto the transom step of a larger vessel. It could also be adapted for use with a floating dock, but it would not be suitable for a fixed dock having a variable freeboard. Like the Horton patent, it achieves vertical storage on the surface of the dock, thereby creating an obstruction. Anderson also shares the disadvantage of Horton of requiring a two-stage attachment-lifting process, since it provides no mechanical advantage for lifting from the water side. Since the vessel is clamped at the gunwale to the lifting arm, moreover, this mechanism is useless for kayaks and can damage canoes and rowboats by the "pinching" stress placed on the gunwale. Additionally, this invention requires modification to the vessel itself as an "eye" must be attached the vessel to secure the hauling line. This invention also lacks a means of securing the vessel in a vertical storage position, unless the hauling line is secured to the larger vessel or dock, once it's lifted out of the water.

The winch-actuated derrick mechanism disclosed in the patent of Platt, U.S. Pat. No. 2,465,118, deploys a flexible cradle loop under the boat, thereby avoiding the "pinching" stress of the Anderson mechanism. But the flexible loop cannot secure the vessel in a vertical position for storage over the water on the side of the dock. The intent of this invention is to drain collected water from the boat and is well suited for its purpose; however, inasmuch as the derrick is rotatable and the flexible cradle is basically two sided, its function as an unmanned storage mechanism is inadequate considering the event of inclement weather. As with Horton and Anderson, the winch lifting mode requires a two-stage attachment-lifting process, and the derrick structure occupies a lot of space on the dock surface. The extent to which the mechanism can operate with a high freeboard is limited by the length of the horizontal boom and the span of the lifting cradle. This invention also lacks the operability from the waterside of the vessel.

In the patent of Lunsman, et al., U.S. Pat. No. 2,815,131, a cradle is formed by two horizontal bars that extend over the gunwales of the boat and two rope-like flexible elements that attach to the bars and extend under the vessel. Since the pivot points of the bars are fixed above the dock surface, the two rope-like flexible elements must be extended to accommodate freeboard variations from dock to dock or seasonally variations for the same dock; with increasing freeboard, however, this invention's purpose of lifting the vessel out of the water and turning the vessel on its side is diminished. This device also lacks a side support under the vessel once it's lifted, so that the sag of the flexible member will render the storage height above the water uncertain and unstable. Lunsman also shares the disadvantages of the other winch-actuated devices in terms of a two-stage operation and obstruction of dock space.

The apparatus taught by the patent of Lasko, U.S. Pat. No. 4,763,593, uses an L-shaped davit assembly under the vessel connected to a dock-mounted lever arm to tilt a boat into a vertical position. The downward extension of the davit into the water is adjustable, thereby accommodating freeboard variations. But, because the davit's pivot point is fixed at dock level, downward extension of the davit has two adverse consequences. Lowering the davit to adjust for dock freeboard increases the distance between the pivot and the vessel's center of gravity, thereby proportionately increasing the force the operator must apply to the lever arm in order to lift the boat. Since the length of the lever arm is fixed, lifting the boat will become quite difficult in high freeboard conditions. Lowering the davit also causes the storage position of the boat to extend further out over the water from the dock edge, which creates an obstruction for other vessels using the dock, as well as multiplying the stress on the davit assembly under windy conditions. Like the other prior art, Lasko does not enable single-stage cradling and lifting (i.e., in which the operator stays on one side of the vessel?) of the boat. The rotation of the lever arm downward to the dock requires the user to bend over pushing downward to the dock (which can cause back injury) where a latch mechanism engages and holds the cradle in horizontal position. Then the lever is lift back to the vertical and the rope is wound taught on the reel guide attached to the upper portion of the lever. To launch, the lever is released, and the operator's hands unwind the rope via the reel guide on upper portion of lever (which can also be ergonomically stressful—the greater the freeboard the greater the torque on the hands).

The patent of Palmer, U.S. Pat. No. 2,294,864, teaches a U-shaped davit, which is pivotally mounted to the stern of a large boat or the side of a floating dock. As with the Anderson patent, this apparatus is useless on a fixed dock that's subject to seasonal freeboard variations. Even as applied to a floating dock, this device becomes very inefficient for freeboard heights of less than a foot, because the reduced length of the lever arm will demand excessive torque to turn the winch. Although the Palmer mechanism provides a more stable storage position with less dock obstruction than the other prior art, it uses hooks to attach the davit to the gunwales of the boat, thereby subjecting the sides of the vessel to potentially damaging pinching and shearing stresses. Since, like the other prior art, the Palmer device does not enable water-side boat lifting, it requires a burdensome two-stage operation.

The foregoing review of the prior art reveals the following principal deficiencies:

1. Obstruction of dock space by the lifting apparatus;
2. Obstruction of dock space by storage of the boat over the dock surface;
3. Two-stage operation: first water-side boat attachment, then dock-side lifting;
4. No means available to operate from the waterside only;
5. No means available to operate from the waterside or dockside at the user's option;
6. Inability to accommodate variable dock freeboard;
7. Excessive lifting force/torque;
8. Lack of stability in the vertical storage position;
9. Potentially damaging shear stress on boat and/or dock sides during lifting;
10. Modification to the vessel itself; and
11. Complicated installation and de-installation for winter storage.

The present invention overcomes these deficiencies by providing a three-sided cradle that is rotatably connected to two lateral supports extending outward from one side of the dock. A person in the water can float the canoe or kayak into the cradle and lift it into a secure vertical storage position on the side of the dock without having to get up on the dock. A pivot point extending out into the water having the ability to be positioned above or below the dock surface has the advantages of both accommodating freeboard and minimizing and maintaining a constant distance between the pivot and the boat's center of gravity, thereby allowing for much less effort in lifting. Depending on the depth of the vessel, the cradle can be dimensioned so that the position of the vessel's center of gravity tends to hold the cradle in a vertical or past-vertical alignment after it's been lifted. Where needed, a cradle latch that can be activated from the water side further secures the storage position. With attachment of a tether cord, the lifting operation could also be performed from the dockside of the vessel and at the user's option.

For purposes of spatial orientation, in the specification and claims for the present invention, the following definitions will be used:

"Longitudinal" or "longitudinally" means the direction in which the dock extends outward into the water, i.e., in the direction of the dock's length;

"Lateral" or "laterally" means the direction perpendicular to longitudinal, i.e., in direction of the dock's width;

"Horizontal" or "horizontally" means in a plane parallel to the surface of the dock;

"Vertical" or "vertically" means in a plane perpendicular to the surface of the dock;

"Loading position" means the orientation of the present invention with the centerline of the cradle in the horizontal plane;

"Storage position" means the orientation of the present invention with the centerline of the cradle in the vertical plane;

"Proximal" means that part of a component of the present invention which is nearest to dock when the present invention is in the loading position;

"Distal" means that part of a component of the present invention which is farthest from the dock when the present invention is in the loading position;

"Upper" means that part of a component of the present invention which is farthest from the water surface when the present invention is in the loading position;

"Lower" means that part of a component of the present invention which is nearest to the water surface when the present invention is in the loading position;

"Inward" or "inwardly" means in the direction toward the centerline of the cradle; and "Outward" or "outwardly" means in the direction away from the centerline of the cradle.

Unless otherwise specified, the described orientation and/or position of a component of the present invention is given with reference to the loading position.

SUMMARY OF THE INVENTION

The present invention comprises a three-sided cradle that is pivotally connected to two dock lateral supports. The dock lateral supports are L-shaped structures, each having a vertical arm and a horizontal arm. The vertical arms are attached to one side of a dock by a dock mounting assembly, while the horizontal arms extend orthogonally laterally outward from the dock side. The dock lateral supports can be attached to the dock at a fixed height above the water level, or alternately they can be slidably attached to the dock through the dock mounting assembly, such that the height of the dock lateral supports can be adjusted for variable freeboard. Alternately or concurrently, a variable height mechanism can be incorporated in the dock mounting assembly to adjust the height of the dock lateral supports for variable freeboard.

The cradle comprises four support structures: a loading member, an upper resting member, and two side resting members. The loading member and the upper resting member can both be rigid members, or one of them can be a flexible member. In their rigid embodiments, the loading member and the upper resting member are open-sided rectangular structures, which are open at the proximal sides of the rectangles. The open sides of the loading member and the upper resting member are orthogonally connected by the two side resting members. The side resting members are connected to two pivot joints on the horizontal arms of the dock lateral supports through two pivot members that extend orthogonally outward from the side resting members. The locations of the pivot joints on the horizontal arms of the dock lateral supports can be fixed or slidably adjustable, as can the locations of the pivot members on the side resting members.

The loading member comprises a loading member crossbar and two loading member laterals. The loading member crossbar is horizontally and longitudinally aligned parallel to the dock side. The loading member crossbar is connected at either end to two loading member laterals, which are horizontally and laterally aligned perpendicular to the dock side. The length of the loading member crossbar, which defines the width of the cradle, is less than the length of the vessel to be stored, but optimally not less than two feet, in order to ensure that the center of gravity of the vessel is securely positioned within the cradle. The length of the loading member laterals, which establishes the depth of the cradle, is optimally approximately equal to the beam (maximum width) of the vessel to be stored, but it must be greater than half the beam of the vessel to ensure that the vessel's center of gravity is positioned within the cradle.

The upper resting member comprises an upper resting member crossbar and two upper resting member laterals. The upper resting member is horizontally and longitudinally aligned parallel to the dock side. The upper resting member crossbar is connected at either end to two upper resting member laterals, which are horizontally and laterally aligned perpendicular to the dock side. The length of the upper resting member crossbar is equal to or less than that of the loading member crossbar. The length of the upper resting member laterals can be equal to or less than that of the loading member laterals, but it must be greater than half the beam of the vessel to ensure that the vessel's center of gravity is positioned within the cradle. The length of the upper resting member laterals must also be sufficient to ensure that the upper resting member extends completely over the cockpit opening of the vessel, in order to prevent the distal end of the upper resting member from entering the cockpit when the cradled vessel is pivoted upward.

The side resting members rigidly orthogonally connect the proximal ends of the loading member laterals and the upper resting member laterals, thereby creating a cradle opening between the loading member crossbar and the upper resting member crossbar. The length of the side resting member establishes the height of the cradle opening, which must be larger than the height of the vessel to be stored. The extent to which the cradle opening height is greater than the vessel height will affect the angle at which the stored vessel rests with respect to the vertical, as will be discussed in the detailed description which follows.

For purposes of orientation, the cradle has a centerline, which is aligned horizontally and laterally and is equidistant from the two upper resting member laterals, equidistant from the two loading member laterals, and equidistant from the loading member crossbar and the upper resting member crossbar.

In alternate embodiments, as mentioned previously, either the rigid loading member or the rigid upper resting member can be replaced by one or more flexible members, which can be adjustable straps. In these embodiments, preferably, there are two straps, with one end of the straps attached at or near the proximal end of the rigid member and the other end of the straps attached at or near the distal end of the rigid member. In one version of these alternate embodiments, for example, the upper resting member is rigid and has the structure described above, while the loading member comprises two straps. The proximal end of each strap may be attached (via a cam buckle or a more permanent attachment means) either to the side resting member at or near the proximal end of one of the upper resting member laterals, or to the upper resting member at or near the upper end of the side resting member, while the distal end of each strap is attached at or near the distal end of one of the upper resting member laterals. At the distal and/or proximal ends of the straps, there are strap tightening means, such as cam buckles.

In another alternate embodiment, a pivot rod is pivotally connected horizontally and longitudinally between the horizontal arms of the two dock lateral supports orthogonally at the pivot joints, such that the pivot rod is aligned parallel to the dock side. The proximal ends of the loading member laterals are orthogonally rigidly attached to a short cradle sleeve. The proximal ends of the upper resting member laterals are orthogonally rigidly attached to the upper ends of the side resting members. The lower ends of the side resting members are orthogonally rigidly attached to the short cradle sleeve inwardly adjacent to the proximal ends of the loading member laterals. In this configuration, the length of the upper resting member crossbar is less than that of the loading member crossbar.

A vessel is loaded into the cradle by first adjusting the positions of the pivots joints, pivot members and/or the height of the dock lateral supports, to the extent that the particular embodiment of the present invention enables such adjustments. As previously noted, the height adjustment of the dock lateral supports can accommodate freeboard variations. As will be explained in the detailed description which follows, adjustments with respect to the locations of the pivot members and/or the pivot joints can alter the ultimate storage location of the vessel in terms of height and distance from the dock side.

After the appropriate adjustments are made, the cradle is rotated into the loading position, in which the loading member and the upper resting member are horizontal or tilted slightly downward toward the water surface. For the rigid embodiments, the vessel is positioned on the water side of the cradle parallel to the cradle opening and is pushed and, if necessary, lifted sideways into the cradle. For the flexible embodiments, the vessel is positioned with its centerline perpendicular to the rigid member lateral and is pushed/lifted under or over the catenary of the loosened strap; then the vessel is secured by tightening the strap. After the vessel is in the cradle, the vessel is lifted into its storage position by pivoting the cradle upward into a vertical alignment. The cradle is pivoted upward by applying an upward radial force to the loading member crossbar and/or the upper resting member crossbar. This can be done from the waterside, or it can be done from the dockside of the cradle, with the aid of a rope or tether cord attached to the loading member or upper resting member crossbar.

When the cradle with the vessel within it has been pivoted to the vertical position, the loading member and the upper resting member are perpendicular to the water surface and the dock surface. In this position, a latching mechanism on the dock surface may be needed to hold the cradle in the vertical alignment, depending on the location of the pivot joint with respect to the center of gravity of the vessel. This mechanism and other features of the present invention will be further described in the detailed description of the preferred embodiments of the present invention that follows.

BRIEF DESCRIPTION OF THE DRAWINGS

FIGS. 1A and 1B are perspective views of one of the preferred embodiments of the present invention in the storage position and loading position, respectively.

FIG. 2 is a cross-section view of the cradle of one of the preferred embodiments of the present invention in the loading position.

FIGS. 3A and 3B are cross-section views of the cradle of one of the preferred embodiments of the present invention in the storage position.

FIG. 7 is a cross-section view of the cradle of one of the preferred embodiments of the present invention showing alternate locations of the pivot joint.

FIGS. 8A and 8B are schematic illustrations of the movement of the cradle of one of the preferred embodiments of the present invention with different pivot joint locations.

FIGS. 9A and 9B are schematic illustrations, respectively, of the opportunity for increased pivot height through the use of the vessel's buoyancy characteristics, and the opportunity for increased pivot height with the use of a cradle having a flexible loading member.

FIGS. 10A and 10B are perspective views of one of the preferred embodiments of the present invention having an extended cradle cross member; FIG. 10C is a cross section view of the same embodiment showing the extended cross section member resting on the horizontal arms of the dock lateral supports in the storage position.

FIGS. 13A, 13B, and 13C are perspective detail views of a dock mount lateral sliding pivot point assembly used in one of the preferred embodiments of the present invention.

FIGS. 14A, 14B, and 14C are cross section views illustrating the function of the dock mount lateral sliding pivot in conjunction with an extended cross bar added to the cradle.

FIGS. 18A and 18B are side detail views of a latch and release assembly and a latch and release mechanism, respectively.

FIGS. 19A and 19B are sequential operational views of the latch and release mechanism in the latching operation and the release operation, respectively.

FIGS. 20A, 20B, and 20C are side perspective view of three different configurations of a fixed-height dock mounting assembly

FIGS. 23A and 23B are cross section views of a leverage-controlled variable-height dock mounting assembly.

FIGS. 24A, 24B, and 24C are perspective views of the components of a three piece dock mount assembly incorporating the function of a pivot lateral height adjustment.

FIGS. 25A and 25B are perspective views of one of the preferred embodiments of the present invention, which incorporates a pivot rod lateral crossbar that engages the female pivots provided on the cradle assembly and both dock laterals supports.

FIGS. 26A, 26B, and 26C are perspective views of three basic applications of the present invention, each illustrating the loading and storage position.

DETAILED DESCRIPTION OF THE PREFERRED EMBODIMENTS

Figure 4:
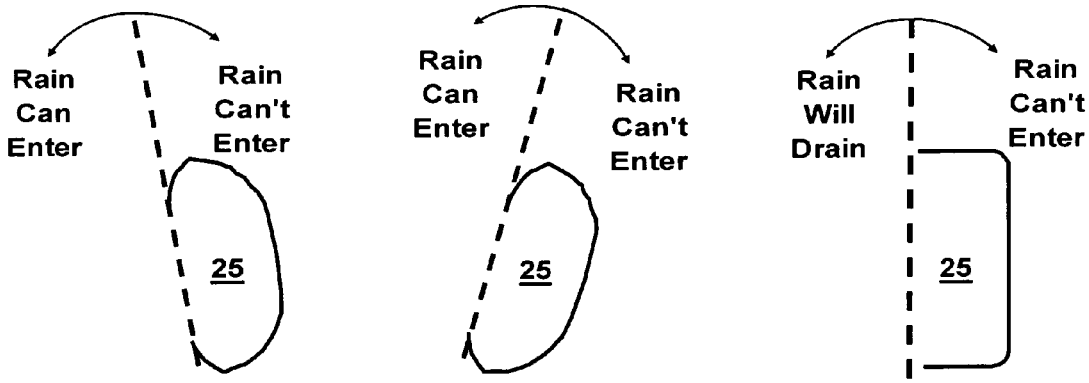
FIG. 4 is a schematic depiction of three alternate vessel storage angles.

Referring to FIGS. 1A, 1B and 2, the present invention 10 comprises a three-sided cradle 11 that is pivotally connected to two dock lateral supports 12. The dock lateral supports 12 are L-shaped structures, each having a vertical arm and a horizontal arm. The vertical arms are attached to one side of a dock 13 by a dock mounting assembly 14, while the horizontal arms extend orthogonally laterally outward from the dock side 15. The dock lateral supports 12 can be attached to the dock 13 at a fixed height above the water level, through the use of a fixed-height dock mounting assembly 14, such as any of the configurations illustrated in FIG. 20A, 20B or 20C. Alternately, the vertical arms of the dock lateral supports 12 can be slidably attached to the dock side 15, as illustrated in FIGS. 21A, 21B, 22A, 22B and 24A, 24B, 24C, such that the height of the dock lateral supports 12 can be adjusted for variable freeboard. Alternately or concurrently, a variable height mechanism, such as the one illustrated in FIGS. 23A, 23B, can be incorporated in the dock mounting assembly 14 to adjust the height of the dock lateral supports 12 for variable freeboard.

The cradle 11 comprises four support structures: a loading member 16, an upper resting member 17, and two side resting members 18. The loading member 16 and the upper resting member 17 can both be rigid members, or one of them can be a flexible member. In their rigid embodiments, the loading member and the upper resting member are open-sided rectangular structures, which are open at the proximal sides of the rectangles. The open sides of the loading member 16 and the upper resting member 17 are orthogonally connected by the two side resting members 18. The side resting members 18 are connected to two pivot joints 19 on the horizontal arms of the dock lateral supports 12 through two pivot members 20 that extend orthogonally outward from the side resting members 18.

Figure 11A:
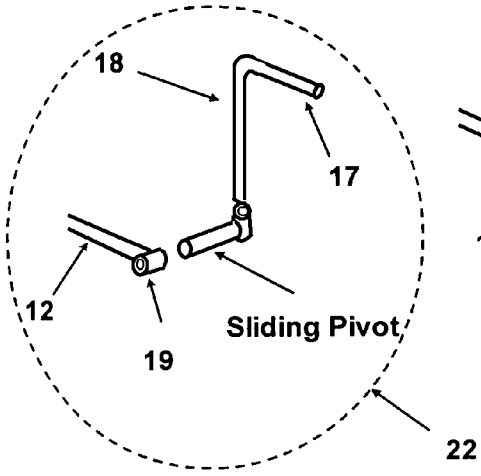
FIGS. 11A, 11B and 11C are perspective detail views of a cradle sliding pivot member assembly used in one of the preferred embodiments of the present invention.
Figure 11B:
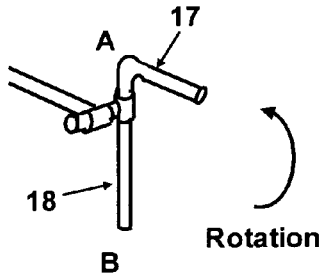
Figure 11C:
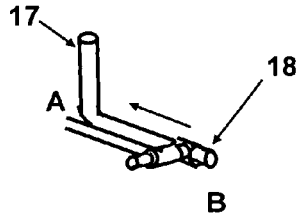
Figure 15A:
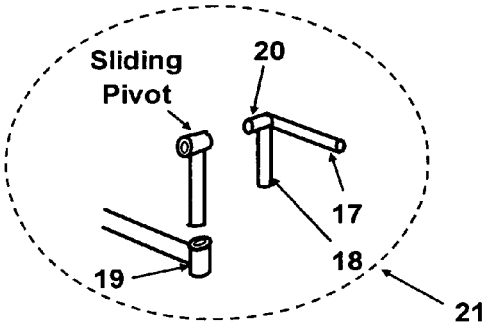
FIGS. 15A, 15B and 15C are perspective detail views of a vertical sliding pivot point assembly used in one of the preferred embodiments of the present invention.
Figure 15B:
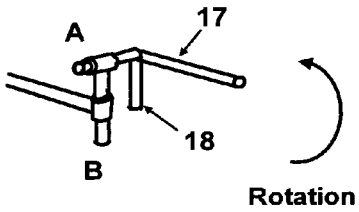
Figure 15C:
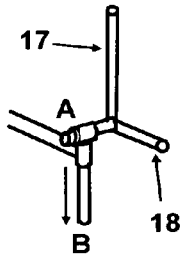
Figure 16A:
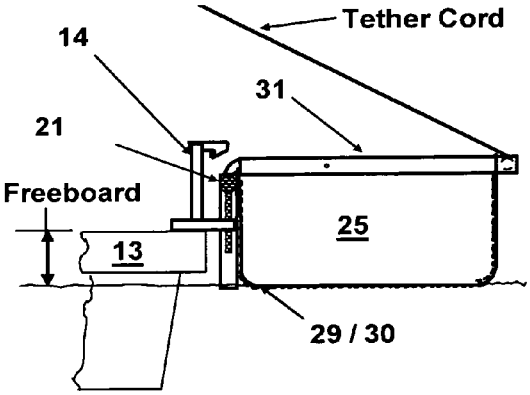
FIGS. 16A and 16B are cross section views of one of the preferred embodiments of the present invention adapted for use with a floating dock, shown in the loading position.
Figure 16B:
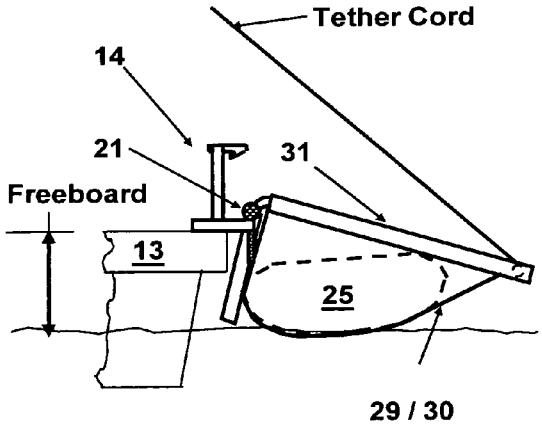
Figure 17A:
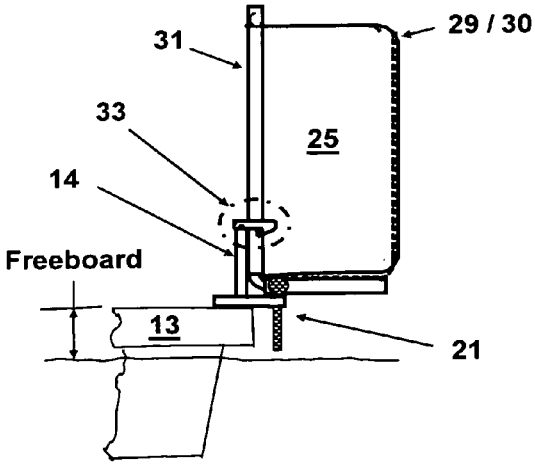
FIGS. 17A and 17B are cross section views of one of the preferred embodiments of the present invention adapted for use with a floating dock, shown in the storage position.
Figure 17B:
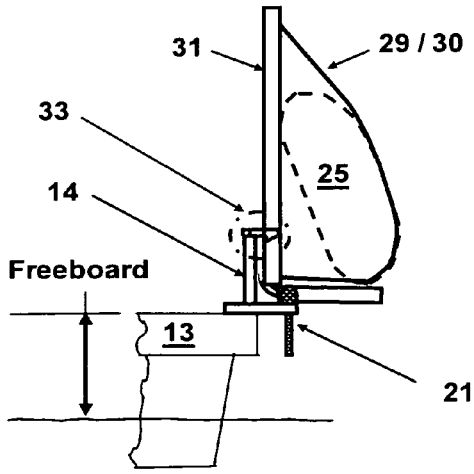
Figure 21A:
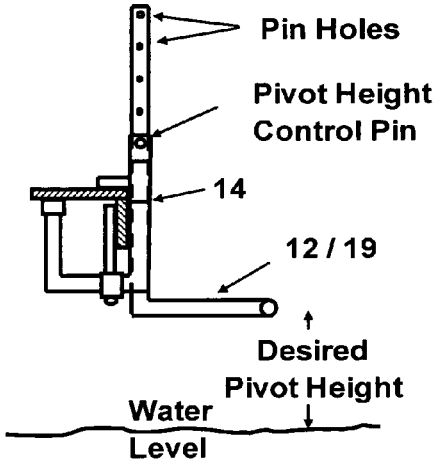
FIGS. 21A and 21B are cross section views of a pin-controlled variable-height dock mounting assembly.
Figure 21B:
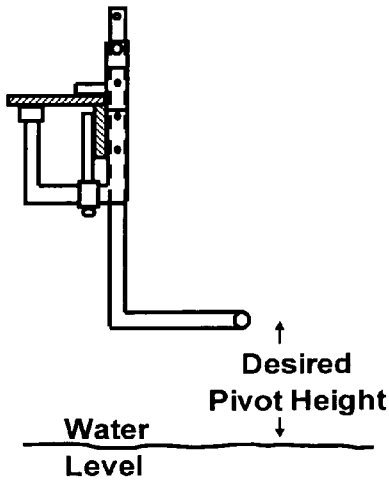
Figure 22A:
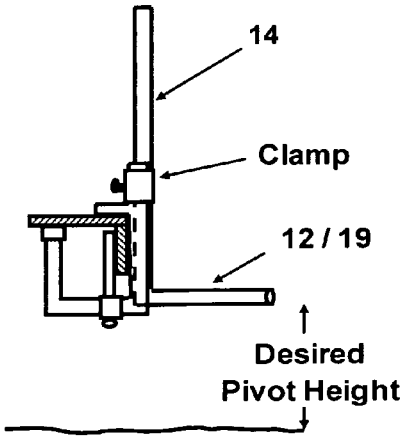
FIGS. 22A and 22B are cross section views of a clamp-controlled variable-height dock mounting assembly.
Figure 22B:
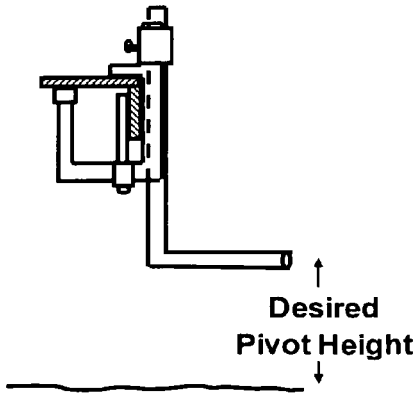

The locations of the pivot joints 19 on horizontal arms of the dock lateral supports 12 can be fixed or slidably adjustable. An exemplary vertical sliding pivot joint assembly 21 is illustrated in FIGS. 15A, 15B and 15C. The locations of the pivot members 20 on the side resting members 18 can also be fixed or slidably adjustable. An exemplary cradle sliding pivot member assembly 22 is depicted in FIGS. 11A, 11B and 11C. An exemplary dock mount lateral sliding pivot member assembly 34 is depicted in FIGS. 13A, 13B, and 13C.

Figure 5:
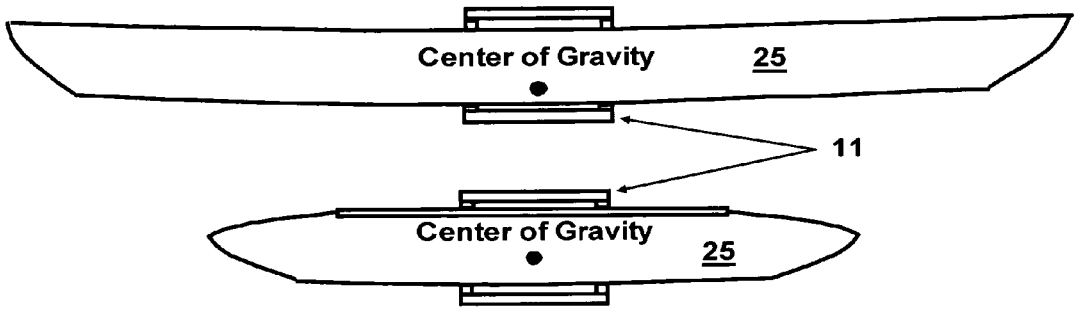
FIG. 5 is a schematic illustration of the relationship between cradle width and the longitudinal position of the vessel's center of gravity.

The loading member 16 comprises a loading member crossbar 23 and two loading member laterals. The loading member crossbar is horizontally and longitudinally aligned parallel to the dock side 15. The loading member crossbar 23 is connected at either end to two loading member laterals 24, which are aligned horizontally and laterally perpendicular to the dock side 15. Thus, the loading member crossbar 23 corresponds to the longitudinal side of the open-sided rectangular structure, while the two loading member laterals 24 correspond to the two lateral sides of the open-sided rectangular structure. The length of the loading member crossbar 23, which defines the width of the cradle 11, is less than the length of the vessel 25 to be stored, but optimally not less than two feet, in order to ensure that the center of gravity of the vessel 25 is securely positioned within the cradle 11, as illustrated in FIG. 5. The length of the loading member laterals 24, which establishes the depth of the cradle 11, is optimally approximately equal to the beam (maximum width) of the vessel 25 to be stored, but it must be greater than half the beam of the vessel 25 to ensure that the vessel's center of gravity is positioned within the cradle 11.

The upper resting member 17 comprises an upper resting member crossbar 26 and two upper resting member laterals 27. The upper resting member crossbar 26 is horizontally and longitudinally aligned parallel to the dock side 15. The upper resting member crossbar 26 is connected at either end to two upper resting member laterals 27, which are horizontally and laterally aligned perpendicular to the dock side 15. Thus, the upper resting member crossbar 26 corresponds to the longitudinal side of the open-sided rectangular structure, while the two upper resting member laterals 27 correspond to the two lateral sides of the open-sided rectangular structure. In the preferred embodiment depicted in FIGS. 1A, 1B and 2, the length of the upper resting member crossbar 26 is equal to that of the loading member crossbar 23. The length of the upper resting member laterals 27 can be equal to or less than that of the loading member laterals 24, but their length must be greater than half the beam of the vessel 25 to ensure that the vessel's center of gravity is positioned within the cradle 11. The length of the upper resting member laterals 27 must also be sufficient to ensure that the upper resting member 17 extends completely over the cockpit opening of the vessel 25, in order to prevent the distal end of the upper resting member 17 from entering the cockpit when the cradled vessel 25 is pivoted upward.

The side resting members 18 rigidly orthogonally connect the proximal ends of the loading member laterals 24 and the upper resting member laterals 27, thereby creating a cradle opening 28 between the loading member crossbar 23 and the upper resting member crossbar 26. The length of the side resting member 18 establishes the height of the cradle opening 28, which must be larger than the height of the vessel 25 to be stored. The extent to which the height of the cradle opening 28 is greater than the height of the vessel 25 will affect the angle at which the stored vessel 25 rests with respect to the vertical, as shown in FIGS. 3A and 3B. As illustrated in FIG. 4, the angle at which the stored vessel rests with respect to the vertical is a factor in terms of rain entering and draining from the cockpit of a stored vessel 25.

In alternate embodiments, as mentioned previously, either the rigid loading member 16 or the rigid upper resting member 17 can be replaced by one or more flexible members 29, which can be adjustable straps 30. Examples of these flexible-member embodiments are depicted in FIGS. 6A and 6B, and in FIGS. 16A, 16B, 17A and 17B, as applied to a floating dock. Preferably, there are two straps 30, with one end of the straps 30 attached at or near the proximal end of the rigid member 31 and the other end the straps 30 attached at or near the distal end of the rigid member 31. In one version of these alternate embodiments, for example, the upper resting member 17 is rigid and has the structure described above, while the loading member 16 comprises two straps 30. The proximal end of each strap 30 is attached at or near the proximal end of one of the upper resting member laterals 27, while the distal end of each strap 30 is attached at or near the distal end of one of the upper resting member laterals 27. At the distal and/or proximal ends of the straps 30, there are strap tightening means, such as cam buckles.

In another alternate embodiment of the rigid-member variety, as shown in FIG. 25, a pivot rod 32 is pivotally connected horizontally and longitudinally between the horizontal arms of the two dock lateral supports 12 at the pivot joints 19, such that the pivot rod 32 is aligned parallel to the dock side. The proximal ends of the loading member laterals 24 are orthogonally rigidly attached near the ends of the short cradle sleeves 35 inwardly adjacent to the pivot joints 19. The proximal ends of the upper resting member laterals 27 are orthogonally rigidly attached to the upper ends of the side resting members 18. The lower ends of the side resting members 18 are orthogonally rigidly attached to a short cradle lateral 35 inwardly adjacent to the proximal ends of the loading member laterals 24. The short cradle sleeves 35 provide an inner diameter that functions as the female portion of a pivot joint. The pivot rod 32 slides through the first pivot joint 19, then through both short cradle sleeves 35, and then through the second pivot joint 19. Lynch pins 36 are then inserted through both ends of the pivot rod 32 securing the pivot rod 32 in place. The cradle 11 is now free to rotate about pivot rod 32. In this configuration, the length of the upper resting member crossbar 26 is less than that of the loading member crossbar 23.

Figure 12A:
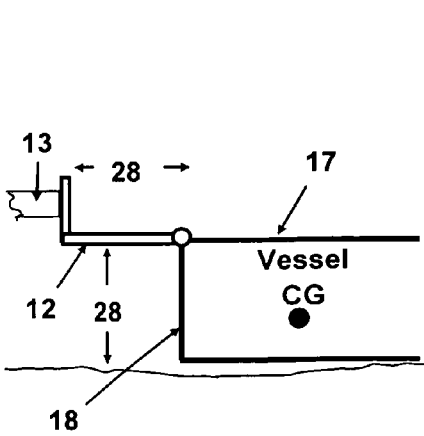
FIGS. 12A, 12B and 12C are schematic illustrations of the function of the cradle sliding pivot member assembly.
Figure 12B:
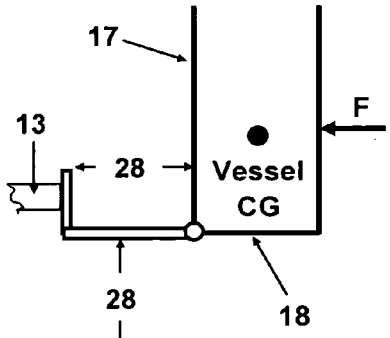
Figure 12C:
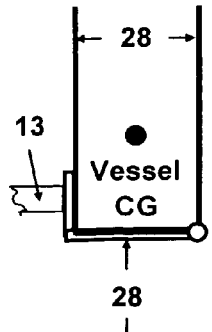

A vessel 15 is loaded into the cradle 11 by first adjusting the positions of the pivots joints 19, pivot members 20 and/or the height of the dock lateral supports 12, to the extent that the particular embodiment of the present invention 10 enables such adjustments. As previously noted, the height adjustment of the dock lateral supports 12 can accommodate freeboard variations. Adjustments with respect to the locations of the pivot members 20 and/or pivot joints 19 can alter the ultimate storage location of the vessel 25 in terms of height and distance from the dock side 15. FIGS. 8A and 8B illustrate the effect on the storage height of the vessel 25 of various locations of the pivot members 20 along the side resting members 18. FIGS. 12A, 12B and 12C illustrate the use of a cradle sliding pivot member 22 assembly (as depicted in FIGS. 11A, 11B and 11C) to achieve a relatively high storage position close to the dock side 15. FIGS. 14A, 14B and 14C illustrated the use of a dock mount lateral sliding pivot member 34 assembly (as depicted in FIGS. 13A, 13B and 13C) to achieve a relatively high storage position close to the dock side 15. Vessel storage height can also be adjusted through the use of a vertical sliding pivot joint assembly 21, such as the one depicted in FIGS. 15A, 15B and 15C.

After the appropriate adjustments are made, the cradle 11 is rotated into the loading position, in which the loading member 16 and the upper resting member 17 are horizontal or tilted slightly downward toward the water surface. For the rigid embodiments, the vessel 25 is positioned on the water side of the cradle 11 parallel to the cradle opening 28 and is pushed and, if necessary, lifted sideways into the cradle 11. For the flexible embodiments, the vessel 25 is positioned with its centerline perpendicular to the rigid member lateral 31 and is pushed/lifted under or over the catenary of the loosened strap 30; then the vessel 25 is secured by tightening the strap 30. After the vessel 25 is in the cradle 11, the vessel 25 is lifted into its storage position by pivoting the cradle 11 upward into a vertical alignment. The cradle 11 is pivoted upward by applying an upward force to the loading member crossbar 23 and/or the upper resting member crossbar 26. This can be done from the waterside, or it can be done from the dockside of the cradle 11, with the aid of a rope or tether attached to the available crossbar 23 26.

When the cradle 11 with the vessel 25 within it has been pivoted to the vertical position, the loading member 16 and the upper resting member 17 are perpendicular to the water surface and the dock surface. In this position, a latching mechanism 33 on the dock mounting assembly 14 may be needed to hold the cradle 11 in the vertical alignment, depending on the location of the pivot joints 19 with respect to the center of gravity of the vessel 25. An exemplary latch and release mechanism is illustrated in FIGS. 18A, 18B, 19A and 19B. Alternately, an embodiment of the type depicted in FIGS. 10A, 10B, and 14B incorporating a cradle extended crossbar, can be used to maintain the vertical storage position without the need for a latching mechanism.

FIGS. 26A, 26B and 26C illustrate the three basic principal applications of the present invention, as described below.

FIG. 26A—Floating Dock—"Constant Freeboard"

Under this condition, the floating dock is typically much wider than traditional stationary dock, and the freeboard is relatively constant by virtue of its floating design.

This preferred embodiment comprises:

FIG. 20A Dock Mount Assembly—Bracket/Pin Dock Mount Assembly

A combination of the Cradle Sliding Pivot (FIG. 11A) and Vertical Sliding Pivot (FIG. 15A)

Figure 6:
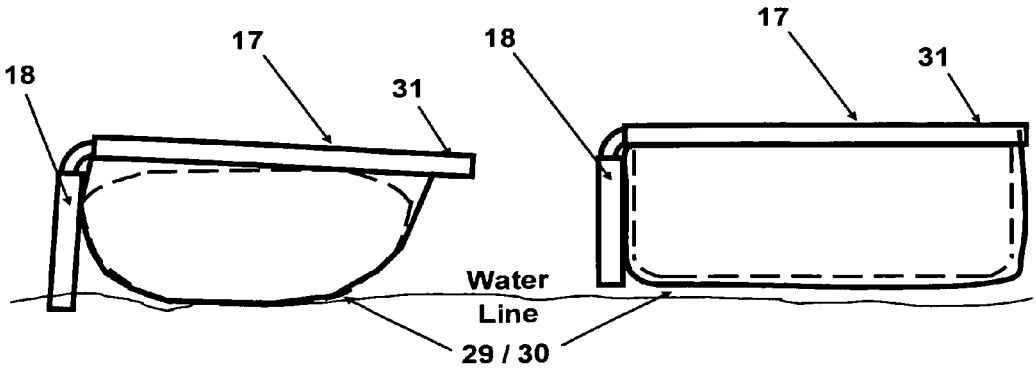
FIG. 6 is a cross-section view of the cradle of one of the preferred embodiments of the present invention in which the loading member is a flexible member.

A Flexible Loading Member Cradle—(FIG. 6)

With this configuration mounted to the floating dock, due to freeboard height and vessel height, the top surface of the vessel may be in a position above or below the floating dock surface. The Vertical Sliding Pivot in combination with the Flexible Loading Member Cradle will accommodate these variances.

In this application the user is on the dock, as the water level is usually to deep for the user to enter the vessel from the water.

The vessel is floated into the cradle 11; the flexible loading member straps 30 are slightly pulled/tightened (on the dock side of the cradle) and held in place with cam buckles. The user then grasps the tether cord (which could be an extension of the flexible loading strap extending from the resting member crossbar side of the cradle), and then pulls the cradle 11 into its vertical position. Once vertical, the user would grasp the upper resting member crossbar 26 and slide the cradle 11 (via the cradle sliding pivot) such that the cradle "sits" on the pivot on one side and on the dock on the other. To lower the vessel back into the water the process is reversed.

FIG. 26B—Waterside Loading and Racking

Under this condition, the user is in the water; where the water depth is such where the user could easily position him/herself to enter the canoe or kayak while in the water.

This preferred embodiment is comprises:

Dock Mount Assembly FIG. 20C—Surface Lateral/Pin Dock Mount Assembly

FIG. 22 or FIG. 24 configured as—Clamp Controlled Dock Lateral Support Height Adjustment FIG. 13, A Dock Mount Lateral Sliding Pivot FIG. 2 and FIG. 3—A Rigid Member Cradle with a FIG. 10 Extended Crossbar positioned as shown in FIG. 14

The configured components would be mounted to the stationary dock and the dock lateral 12 would be adjusted to its desired height. The user would float the canoe or kayak into the cradle 11 and, using the upper resting member 17 and or the loading member 16, the user would then rotate the cradle 11 to a vertical position. The user would then push the cradle 11 toward the dock such that the cross bar, when the cradle is lowered, would sit on the horizontal arm of the dock lateral support 12 maintaining a stable condition of storage. To lower the cradle/vessel back into the water for launching purposes the loading process would be reversed.

To adjust for changes in freeboard throughout the season, the user would use the buoyancy technique as illustrated in FIG. 9A and exercise the function of the Clamp Controlled Dock Mount Pivot Lateral Member Height adjustment per FIG. 22 or FIG. 24.

FIG. 26C—Dockside or Waterside Load and Racking

This preferred embodiment would enable the user to either be dockside or waterside to exercise the function of this invention.

This preferred embodiment comprises:

Dock Mount Assembly FIG. 20C—Surface Lateral/Pin Dock Mount Assembly

FIG. 22 or FIG. 24 configured as—Clamp Controlled Dock Lateral Member Height Adjustment A Fixed Pivot, located close to the dock mount assembly, essentially a very short Dock Mount Pivot Assembly Lateral A Flexible Loading Member Cradle—(FIG. 6)

A Latch Release Mechanism FIGS. 18 and 19, wherein the Latch is located on the Resting Member and the Latch Pin is mounted on the Dock Mount Vertical Member.

The configured components would be mounted to the stationary dock and the dock lateral would be adjusted to its desired height. The user would float the canoe or kayak into the cradle and, using the upper resting member 17 and vessel (if in the water) or a tether cord (if on the dock), the user would then rotate the cradle 11 to a vertical position where the latch release mechanism engages and latches the cradle and vessel in place. To lower the cradle/vessel back into the water for launching purposes, the user would "push" (if in the water) or "pull" (if on the dock) the vessel/cradle until the latch release link engages. Then the user would lower the cradle/vessel into the water using either the tether cord or vessel and upper resting member 17 (dependent on the location of the user).

To adjust for changes in freeboard throughout the season; the user would use the Flexible Loading Member Cradle technique as discussed in association with FIG. 9B and exercise the function of the Clamp Controlled Dock Mount Pivot Lateral Member Height adjustment as discussed in association with FIG. 22 or FIG. 24

Although the preferred embodiments of the present invention has been disclosed for illustrative purposes, those skilled in the art will appreciate that many additions, modifications and substitutions are possible, without departing from the scope and spirit of the present invention as defined by the accompanying claims.

What is claimed is:

1. A device for storing a small vessel on a side of a dock, the device comprising:

a cradle, two dock lateral supports and two dock mounting assemblies;

wherein the cradle comprises four interconnected support structures, consisting of two horizontal support structures, one of which is an upper horizontal support structure and the other of which is a lower horizontal support structure, and two vertical support members, which support structures enclose a cradle opening within which the vessel rests;

wherein the two dock lateral supports are L-shaped structures that each comprise a vertical arm, a horizontal arm, and a pivot joint;

wherein the dock mounting assemblies comprise means by which the vertical and/or horizontal arms of the two dock lateral supports are secured to the side of the dock; and wherein the cradle is supported by the horizontal arms of the two dock lateral supports and is rotatably attached to the horizontal arms of the two dock lateral supports by two female pivot joints located on the horizontal arms, which pivot joints cooperate conjugately with two male pivot members located on vertical support members, such that the cradle can be lifted from a horizontal loading position to a vertical storage position by the application of a sufficient upward force on one of the two horizontal support structures.

2. The device according to claim 1, wherein the two horizontal support structures comprise two rectangular structures, each having one open side, which open sides are orthogonally connected by the two vertical support members.

3. The device according to claim 2, wherein the two pivot joints are each attached to the horizontal arms of the dock lateral supports by a horizontally slidable sleeve, such that the position of each pivot joint is laterally adjustable.

4. The device according to claim 2, wherein the two pivot joints are each attached to one of the horizontal arms of the dock lateral supports by a vertically slidable sleeve, such that the position of each pivot joint is vertically adjustable.

5. The device according to claim 2, wherein the two pivot members are each attached to one of the vertical support members by a vertically slidable sleeve, such that the position of each pivot member is vertically adjustable.

6. The device according to any one of claims 2-5, wherein the vertical arms of the two dock lateral supports are each attached to one of the dock mounting assemblies by a vertically slidable sleeve, such that the position of each dock lateral support is vertically adjustable.

7. The device according to any one of claims 2-5, wherein each of the dock mounting assemblies further comprise a means for adjusting the vertical position of the dock lateral support.

8. The device according to claim 1, wherein the upper horizontal support structure comprises rectangular structure having one open side, which open side is orthogonally connected to the two vertical support members, and wherein the lower horizontal support structure comprises two elongate, laterally-oriented flexible members, each forming a catenary, and wherein the proximal end of each flexible member is attached by a proximal attachment means to one of the vertical support members at or near the upper end of the vertical support member, and wherein the distal end of each flexible member is attached by a distal attachment means to the upper horizontal support structure at or near the distal end of the upper horizontal support structure, and wherein the proximal attachment means and the distal attachment means each incorporates a tightening mechanism, by means of which the length and curvature of the catenary formed by each flexible member can be adjusted to conform to the size and shape of the vessel.

9. The device according to claim 1, wherein the upper horizontal support structure comprises rectangular structure having one open side, which open side is orthogonally connected to the two vertical support members, and wherein the lower horizontal support structure comprises two elongate, laterally-oriented flexible members, each forming a catenary, and wherein the proximal end of each flexible member is attached by a proximal attachment means to the upper horizontal support structure at or near the proximal end of the upper horizontal support structure, and wherein the distal end of each flexible member is attached by a distal attachment means to the upper horizontal support structure at or near the distal end of the upper horizontal support structure, and wherein the proximal attachment means and the distal attachment means each incorporates a tightening mechanism, by means of which the length and curvature of the catenary formed by each flexible member can be adjusted to conform to the size and shape of the vessel.

10. The device according to either of claim 8 or 9, wherein the two pivot joints are each attached to one of the horizontal arms of the dock lateral supports by a horizontally slidable sleeve, such that the position of each pivot joint is laterally adjustable.

11. The device according to either of claim 8 or 9, wherein the two pivot joints are each attached to one of the horizontal arms of the dock lateral supports by a vertically slidable sleeve, such that the position of each pivot joint is vertically adjustable.

* * * * *